United States Patent [19]

Klimowicz

[11] 4,398,641

[45] Aug. 16, 1983

[54] INVERSION PROTECTION FOR RAILROAD CAR COUPLER

[75] Inventor: Richard F. Klimowicz, West Seneca, N.Y.

[73] Assignee: Dresser Industries, Inc., Dallas, Tex.

[21] Appl. No.: 261,334

[22] Filed: May 7, 1981

[51] Int. Cl.[3] ..... B61G 3/04

[52] U.S. Cl. ..... 213/109; 213/147

[58] Field of Search ..... 213/146, 147, 148, 153, 213/145, 62 A, 109, 122, 136, 158, 156, 139; 292/183, 184, 189

[56] References Cited

U.S. PATENT DOCUMENTS

| | | | |
|---|---|---|---|
| 2,585,958 | 2/1952 | Metzger | 213/146 |
| 2,919,038 | 12/1959 | Metzger | 213/148 |
| 3,029,956 | 4/1962 | De Penti | 213/147 |
| 3,433,369 | 3/1969 | Metzger et al. | 213/148 |
| 4,172,530 | 10/1979 | Altherr et al. | 213/148 |

*Primary Examiner*—Robert B. Reeves
*Assistant Examiner*—Richard Mathieu
*Attorney, Agent, or Firm*—B. E. Deutsch

[57] ABSTRACT

A knuckle railway car coupler includes latching means for maintaining the coupler locked when the coupler is placed in an inverted position. The latching means includes a latching member connected to the lever of the rotary lock-lift assembly of the coupler and is supported thereon in an inoperative position when the coupler is in its normal, upright working position. An abutment member extends into the chamber defined by the coupler head. The latching member is spaced from the abutment member in the inoperative position and moves into engagement therewith when the coupler is inverted to prevent rotation of the lock-lift assembly and subsequent movement of the coupler lock between locking and unlocking positions.

6 Claims, 2 Drawing Figures

INVERSION PROTECTION FOR RAILROAD CAR COUPLER

BACKGROUND OF THE INVENTION

The present invention relates to knuckle type railway car couplers, and in particular, to a latching arrangement for maintaining the coupler locked when the coupler is placed in an inverted position.

In the transportation of bulk commodities such as coal, railway cars are dumped singly or in pairs while coupled in a train. Each car is provided with a rotary type coupler at one end thereof to facilitate rapid sequential emptying of hopper and gondola type railroad freight cars carrying the bulk commodities. The rotary coupler is provided at one car end and a stationary or non-swiveling coupler is provided at the other car end. The rotary coupler is mated to a non-swiveling coupler extending from the adjacent car while the non-swiveling car coupler is mated to a rotary type coupler extending from the car adjacent thereto.

When the car enters a dump or unload station, the car is rotated to an inverted position to produce a gravity release of its contents. During this movement, the car rotates about its rotary coupler while the non-swiveling coupler rotates with the car.

Heretofore, when the cars are rotated, the rotary lock-lift assembly employed with Association of American Railroad (AAR) type "F" couplers may be inadvertently actuated to shift the coupler lock to an unlocked position. When the cars are returned to their normal, upright position, the coupler lock may fail to return to its locked position, rendering the associated cars candidates for unintentional separation during normal operation of the train.

SUMMARY OF THE INVENTION

Accordingly, it is an object of this invention to prevent unintentional movement of a coupler lock when the coupler has been inverted to maintain the knuckle of the coupler in a locked position.

It is a further object of this invention to provide an anti-creep mechanism in a knuckle type coupler which protects against unlocking of the coupler under conditions which permit unintentional movement of the rotary lock-lift assembly to a coupler unlocking position.

It is a further object of this invention to provide latching means for maintaining a railway car coupler lock in its locked position when the coupler is placed in an inverted position.

It is still another object of this invention to provide a rotary lock-lift assembly for a railway car coupler having a latching mechanism for preventing the assembly from unintentional movement to a coupler unlocking position during inversion of the car.

These and other objects of the present invention are attained in a knuckle type railway car coupler including latching means for maintaining the coupler locked when the coupler is placed in an inverted position. The latching means includes a latching member connected to the lever of the rotary lock-lift assembly of the coupler and is supported thereon in an inoperative position when the coupler is in its normal upright position. Abutment means extends into a chamber defined by the head of the coupler. The latching member is spaced from the abutment means in the inoperative position and moves into engagement therewith when the coupler is inverted.

DESCRIPTION OF THE PREFERRED EMBODIMENT

Figure 1:
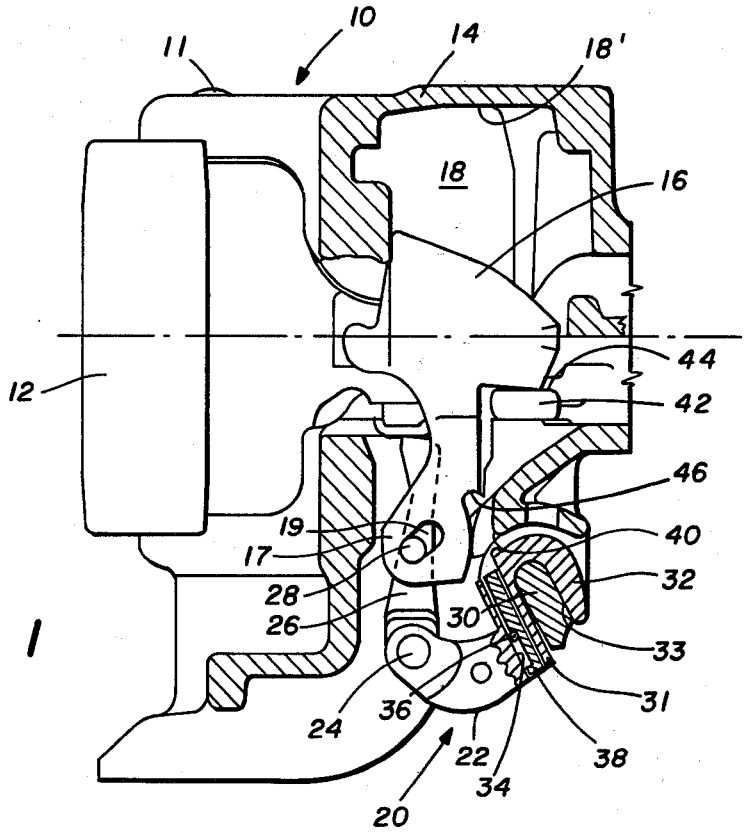
FIG. 1 illustrates a sectional view of a knuckle type railway car coupler embodying the present invention in its normal, upright working position.
Figure 2:
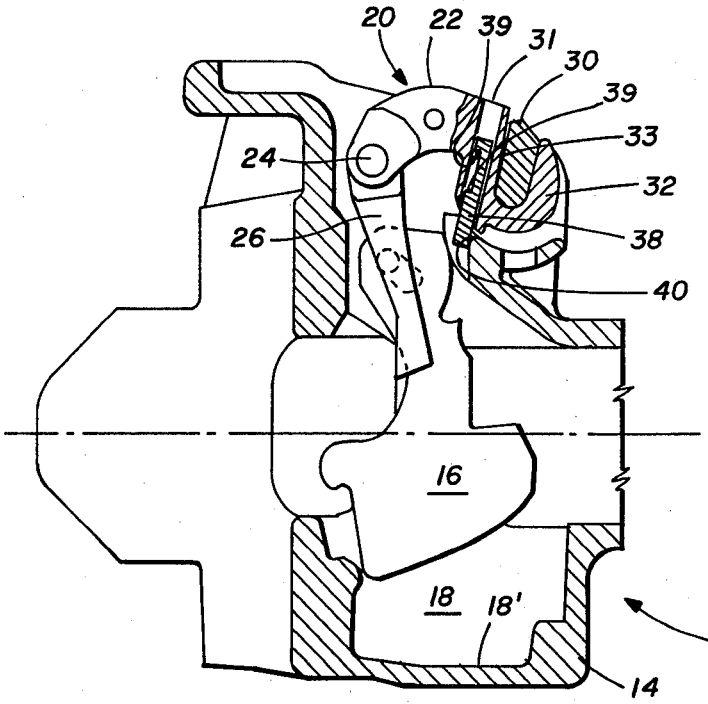
FIG. 2 is a view similar to FIG. 1 illustrating the coupler in an inverted position.

Referring now to the drawing, there is disclosed a preferred embodiment of the present invention. In particular, the invention is embodied in a knuckle type railway coupler 10 such as a rotary-operated A.A.R. standard "F" coupler. Coupler 10 includes knuckle 12 pivotally connected through pin 11 to coupler head 14. Head 14 defines a cavity 18 in which lock 16 is movably mounted. The lock moves within chamber 18 between a lower locking position limiting pivotal movement of knuckle 12 and an upward unlocking position. As illustrated in FIGS. 1 and 2, lock 16 is in its lower locking position. In its lower locking position, lock 16 is supported on seat 44 of knuckle thrower 42. Lock 16 includes leg 17 having slot 19 formed therethrough.

Movement of the lock between its lower locked position and its upper unlocked position is normally controlled via rotary lock-lift assembly 20. Assembly 20 includes lever 22 pivotally connected via pin means 24 to toggle 26. Toggle 26 includes trunnion 28 disposed within slot 19 of lock leg 17.

Lever 22 has a recess 33 defined by generally U-shaped end portion 32. A rotor member 30 has a complementary surface for fitting within recess 33 of U-shaped portion 32. The rotor further includes an eye (not shown) at one end for attaching an operating rod to the rotor whereby a workman can move lock 16 to its unlocking position through operation of rotary lock-lift assembly 20. The function of the foregoing described parts are well known in the appropriate art as these parts are conventional within knuckle type couplers.

As has been previously discussed, coupler 10 may be employed at one end of a railroad freight car, such as a hopper, having a rotary type coupler connected to the other end. The rotary coupler permits the associated freight car to be inverted. Inversion of the freight car results in simultaneous inversion of the non-rotating coupler. Heretofore, when standard non-rotary couplers have been inverted, lock 16 had a tendency to fall downwardly in chamber 18 due to gravitational forces. The lock will fall until seat 46 formed at the rear of leg 17 passes seat 44 of thrower 42. Upon return of the car and coupler to its normal upright position, the lock is prevented from returning to its normal locked position; seat 46 will engage seat 44 on knuckle thrower 42, and lock 16 assumes a position known as "lock-set". With lock 16 in lock-set position, knuckle 12 may unintentionally open if pulled outward by the adjacent car.

To prevent lock 16 from falling within chamber 18 when coupler 10 is placed in an inverted position, lever 22 is formed with tangential hole 34 preferably formed through inner leg 31 of U-shaped portion 32. A gravity actuated linearly movable latching member 38 is retained within hole 34 via suitable means such as roll pin 36. Preferably, latching member 38 is provided with a pair of axially spaced shoulders 39. As illustrated in FIG. 1, a first of the shoulders is supported on pin 36 when the coupler is in its normal upright working position whereby the top surface of member 38 is retained vertically below the upper surface of lever 22 in an inoperative position.

As indicated previously, FIG. 2 illustrates the coupler in its inverted position. Upon inversion of coupler 10, latching member 38 due to gravitational forces, moves linearly within hole 34 towards closed end 18' of cavity 18. The other of the shoulders of latching member 38 engages roll pin 36 as member 38 moves axially within hole 34 as illustrated in FIG. 2 to retain member 38 in the hole when the coupler is inverted.

As clearly illustrated in FIG. 2, axial movement of latching member 38 when the coupler is placed in an inverted position, places the top surface of member 38 below the upper surface of lever 22 whereby the top surface of member 38 engages abutment means 40 extending into cavity 18.

Engagement of latching member 38 with abutment means 40 prevents lever 22 and consequently rotor lock-lift assembly from being unintentionally displaced when the coupler is inverted, retaining lock 16 in its locked position within cavity 18.

The utilization of the foregoing arrangement of parts provides a relatively inexpensive modification to a standard non-rotating coupler which modification is operable to prevent the coupler from inadvertently being placed in an unlocked condition upon the coupler's inversion.

While a preferred embodiment of the present invention has been described and illustrated, the invention should not be limited thereto but may be otherwise embodied within scope of the following claims.

The embodiments of the invention in which an exclusive property or privilege is claimed are defined as follows:

1. A knuckle type railway car coupler resistant to unlocking at inverted position comprising:

a head having a lock chamber;

a knuckle pivotally suported by the head;

a lock disposed in the chamber and movable therewithin between a lower locking position limiting pivotal movement of the knuckle and an upward unlocking position;

abutment means extending into said chamber; and a rotary lock-lift assembly for moving the lock between its lower and upper positions including a rotatable lever having a generally tangentially extending hole, a gravity operated linearly movable latching member retained in said hole, with the top surface of said latching member being normally disposed beneath the top surface of said lever, said latching member moving axially within said hole upon inversion of said coupler whereby the top surface of said member extends below the top surface of said lever to engage said abutment means to prevent rotation of said lever and subsequent movement of said lock when the coupler is in its inverted position.

2. A rotary lock-lift assembly for a railway car knuckle coupler comprising:

a lever having a recess formed in a lower surface and a generally tangentially extending hole formed through an upper surface, a toggle member pivotally connected to said lever and including a laterally extending trunnion for engaging a slot formed within the leg of the coupler lock, and a rotor member including a projecting surface configured to mate with the recess formed in said lever; and a gravity actuated linearly movable latching member retained in said hole, with the top surface of said latching member being normally disposed beneath the upper surface of said lever, said latching member moving axially within the hole upon inversion of said coupler whereby the top surface of said member extends below the upper surface of the lever.

3. A rotor lock-lift assembly in accordance with claim 2 further including:

a retaining member extending transversely through said hole;

said latching member including a pair of axially spaced shoulders, with one of said shoulders engaged with and the other of said shoulders being spaced from said retaining member when the coupler is in its normal position, and said one shoulder being spaced from and the other of said shoulders being engaged with said retaining member when the coupler is inverted.

4. Latching means for maintaining a railway car knuckle coupler locked when the coupler is placed in an inverted position comprising:

a latching member connected to the lever of the rotary lock-lift assembly of said coupler and supported thereon in inoperative position when the coupler is in its normal working position; and abutment means extending into a chamber defined by the head of the coupler, with said latching member being spaced from said abutment means in the inoperative position and moving into engagement therewith when the coupler is inverted.

5. Latching means in accordance with claim 4 wherein said latching member comprises a lineraly movable member which is moved into engagement with the abutment means through gravitational forces acting thereon when the coupler is inverted.

6. Latching means in accordance with claim 5 wherein said latching member comprises a generally elongated body member having a pair axially spaced shoulders intermediate the ends thereof.

* * * * *